United States Patent [19]

Tanahashi et al.

[11] Patent Number: 4,837,929

[45] Date of Patent: Jun. 13, 1989

[54] DRY SHAVER WITH A READILY REPLACEABLE OUTER SHEARING FOIL

[75] Inventors: Masao Tanahashi; Shiro Yada, both of Kadoma, Japan

[73] Assignee: Matsushita Electric Works, Ltd., Japan

[21] Appl. No.: 152,304

[22] Filed: Feb. 4, 1988

[30] Foreign Application Priority Data

Feb. 20, 1987 [JP] Japan ..... 62-37444
Aug. 25, 1987 [JP] Japan ..... 62-211189

[51] Int. Cl.[4] ..... B26B 19/04

[52] U.S. Cl. ..... 30/43.92; 30/43.6; 30/346.51

[58] Field of Search ..... 30/43, 43.6, 43.9, 43.92, 30/346.51

[56] References Cited

U.S. PATENT DOCUMENTS 3,999,291 12/1976 Boer ..... 30/43.92
4,604,801 8/1986 Ullman et al. ..... 30/43.92
4,606,122 8/1986 Ullman et al. ..... 30/43.92
4,726,116 2/1988 Schweingruber et al. ..... 30/43.92

FOREIGN PATENT DOCUMENTS 3415122 10/1985 Fed. Rep. of Germany .
3623404 1/1988 Fed. Rep. of Germany .

*Primary Examiner*—Frank T. Yost
*Assistant Examiner*—Michael D. Folkerts
*Attorney, Agent, or Firm*—Stevens, Davis, Miller & Mosher

[57] ABSTRACT

A dry shaver has a readily replaceable head frame supporting an outer shearing foil. The head frame is of a generally rectangular configuration with a pair of opposed end walls between which an inner cutter assembly projects from a shaver housing for shearing engagement with the undersurface of the shearing foil. Each of the end wall is integrally formed with a hook for locked engagement with a corresponding stop on the part of the housing to retain the head frame on the top of the housing. Also formed integrally on each of the end walls is a release lever which is capable of resiliently flexing in a direction of disengaging the adjacent hook form the stop, permitting the removal of the head frame. With the provision of forming the release lever on the head frame together with the hook, the removable of the head frame can be made simply by pressing the release levers while holding the head frame itself by the same fingers of the user, greatly enhancing the convenience of replacing the head frame together with the shearing foil.

12 Claims, 11 Drawing Sheets

DRY SHAVER WITH A READILY REPLACEABLE OUTER SHEARING FOIL

BACKGROUND OF THE INVENTION

1. Field of the Invention

The present invention is directed to a dry shaver with a readily replaceable outer shearing foil, and more particularly to a reciprocatory type dry shaver having a replaceable head frame carrying the outer shearing foil.

2. Description of the Prior Art

Dry shavers having a replaceable head frame is already known as disclosed in U.S. Pat. No. 4,604,801 in which an outer shearing foil is fixed to a replaceable head frame and is removable together therewith from a shaver housing for replacement. The head frame is provided at its longitudinal ends with hook elements which are resiliently deformed into a locked engagement with complementary stops formed on the part of the shaver housing when the head frame is placed upon the top of the shaver housing. Provided on the part of the shaver housing are a set of release levers which are capable of resiliently flexing inwardly into contact with the corresponding hook elements of the head frame. Pressing in the release levers will disengage the hook elements from the stops, permitting the removal of the head frame from the shaver housing for a replacement or cleaning purpose.

In the dry shaver of the above construction, when the head frame is intended to be removed, the user must be careful not to accidentally drop the head frame to floor with the shaver housing being supported in one hand and at the same time with the release levers being pressed in by the fingers of the same hand, and with the head frame being pulled from the shaver housing with a particular attention. In this manner, the user is compelled to exert a pressing force by one hand supporting the housing to manipulate the release levers for unlocking the head frame from the housing and at the same time to exert a holding or another pressing force by the other hand on the head frame being removed for preventing the accidental dropping thereof. This manipulation of exerting carefully applying the pressing forces to the individual objects by the respective hands in removing the head frame is rather inconvenient and is not satisfactory for the user always seeking the replacement of the head frame in a manner as easy as possible.

Further, it is required in the above prior shaver to form the resilient hook elements and the resilient release levers both being movable parts respectively on the separate bodies. Therefore, manufacture of the prior shaver involves complicate processing of forming the resilient elements on each of the separate bodies, resulting in an increase in production cost.

SUMMARY OF THE INVENTION

In order to obviate the above inconvenience, the present invention provides an improved dry shaver with a uniquely configured replaceable head frame which is easy to be mounted and demounted to and from a shaver housing. The dry shaver in accordance with the present invention, comprises a housing provided on its top with a generally elongated inner blade assembly driven to reciprocate along its longitudinal axis. A head frame is demountably attached to the housing and carries a shearing foil which comes into hair shearing engagement with the inner blade assembly. The head frame is of rectangular configuration including a pair of opposed end walls connected by opposed side walls and defining within the confines of the walls an opening into which the inner blade assembly project for shearing engagement with the shearing foil. Each of the end walls includes a hook which is engageable with a corresponding stop formed on the part of the housing for retaining the head frame on the top of the housing. Also included in each of the end walls is a release lever which extends in adjacent relation to the hook and is allowed to flex resiliently for disengaging the hook from the corresponding stop, thus permitting the head frame to be removed from the housing. Each release lever has a finger engaging portion exposed to be accessible by the finger of the user. With this provision of forming the hooks and the release levers together on the head frame, it is possible to press in the release levers by the fingers of one hand while securely holding the head frame by the same fingers in the course of removing the head frame, liberating the other hand of the user from any extra work other than to simply support the housing. This greatly enhances the convenience of removing the head frame for replacement and cleaning purposes.

Accordingly, it is a primary object of the present invention to provide an improved dry shaver of which head frame can be removed from the shaver housing in a convenient manner.

In preferred embodiments, both of the hooks and the release levers are made resilient to effect the locking and unlocking the head frame to and from the housing. These resilient or movable members are together formed on the head frame, leaving the housing free from a movable member which may require complicate fabrication technique.

It is therefore another object of the present invention to provide an improved dry shaver in which the head frame can be detachably mounted to the housing without requiring any movable member on the part of the housing, facilitating the design and manufacture of the housing.

The housing is preferably formed on its top with opposed end plates between which the head frame is received for protecting the head frame from external shocks which would be otherwise applied directly to the end walls of the head frame and damage the shearing foil. This is particularly advantageous from the viewpoint that the shearing foil is fragile and is readily impaired when subjected to the shock at it either longitudinal end adjacent the end wall of the head frame.

It is therefore a further object of the present invention to provide an improved dry shaver in which the shearing foil carried on the replaceable head frame can be effectively protected inside of the end plates of the housing.

In preferred embodiments, each of the end plates of the housing is formed with a top-opened generally vertical slot which has a pair of tabs projecting from its side edges to define outwardly of the tabs a portion for receiving the release lever. The tabs are spaced upwardly from the bottom of the slot to define at its lower edges the stop for engagement with the hook, while the tabs project to one another to define therebetween an open-slit passage. The hook cooperative with the stop extends integrally from each end wall of the head frame to be capable of resiliently flexing inwardly and is provided at its lower end with a latch end for locking engagement with the stop. Each release lever extends along the hook outwardly thereof to be resiliently flexible inwardly and has at its lower end an inwardly projecting unlock stab abuttable against the latch end of the hook when flexed inwardly. When the release lever is pressed to be flexed inwardly, the respective unlock stabs will move through the open-slit passages to push the latch ends inwardly for disengaging them respectively from the stops while the lower ends of the release levers adjacent the unlock stabs come into abutment with the tabs so as to limit the inward displacement of the release levers. Thus, the release levers are prevented from excessively urging the hook inwardly, contributing to reducing the fatigue of the hooks as well as the release levers themselves experienced through the repeated mounting and demounting of the head frame, which is therefore a still further object of the present invention.

The release lever is preferred to have its unlock stab spaced from the latch end of the hook to leave therebetween a clearance. With the provision of the clearance, the release lever is given a pre-travel inward movement before it actually acts to disengage the hook from the stop so that the head frame can be only disengaged by enough amount of inward flexing of the release lever, eliminating the possibility of unexpected disengagement of the head frame from the housing.

It is therefore a further object of the present invention to provide an improved dry shaver in which the head frame can be free from unintentional disengagement from the housing.

Extending along the inner edges of the above slot in the end plate of the housing are flanges each of which terminates at its lower end in each of the tabs. Each of the release levers fitted outwardly of the tabs is formed at its upper end with an inwardly projecting bump for constant abutment against the flanges when the head frame is mounted to the housing. The flanges serve to bear against an external shock as applied to the exposed release levers when the shaver is dropped to floor, for example, protecting the head frame from being distorted by such shock and therefore protecting the shearing foil on the head frame. This is most advantageous when the head frame is made from a plastic or like cheap material selected in terms of economical replacement requirement and lacking enough rigidity enduring such shock.

It is therefore a further object of the present invention to provide an improved dry shaver in which the head frame and the shearing foil can be effectively protected from possible shocks as may applied when the shaver is accidentally dropped.

The present invention discloses still further advantageous features such as providing a separate support frame on the top of the housing for demountably receiving the head frame and presenting various types other locking engagements between the hooks and the stops.

These and still other objects and advantages of the present invention will become more apparent from the following description of the preferred embodiments of the present invention when taken in conjunction with the attached drawings.

DESCRIPTION OF THE PREFERRED EMBODIMENTS

First Embodiment <FIGS. 1 to 6>

Figure 1:
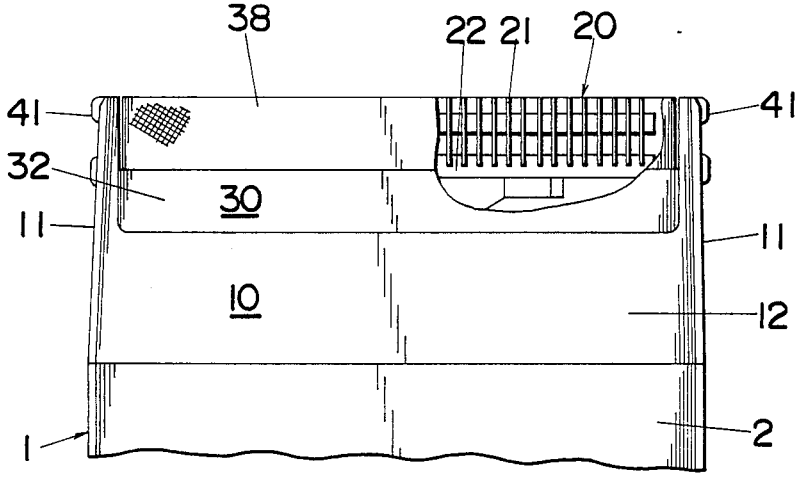
FIG. 1 is a front view, partially cut away, of a dry shaver in accordance with a first embodiment of the present invention.
Figure 2:
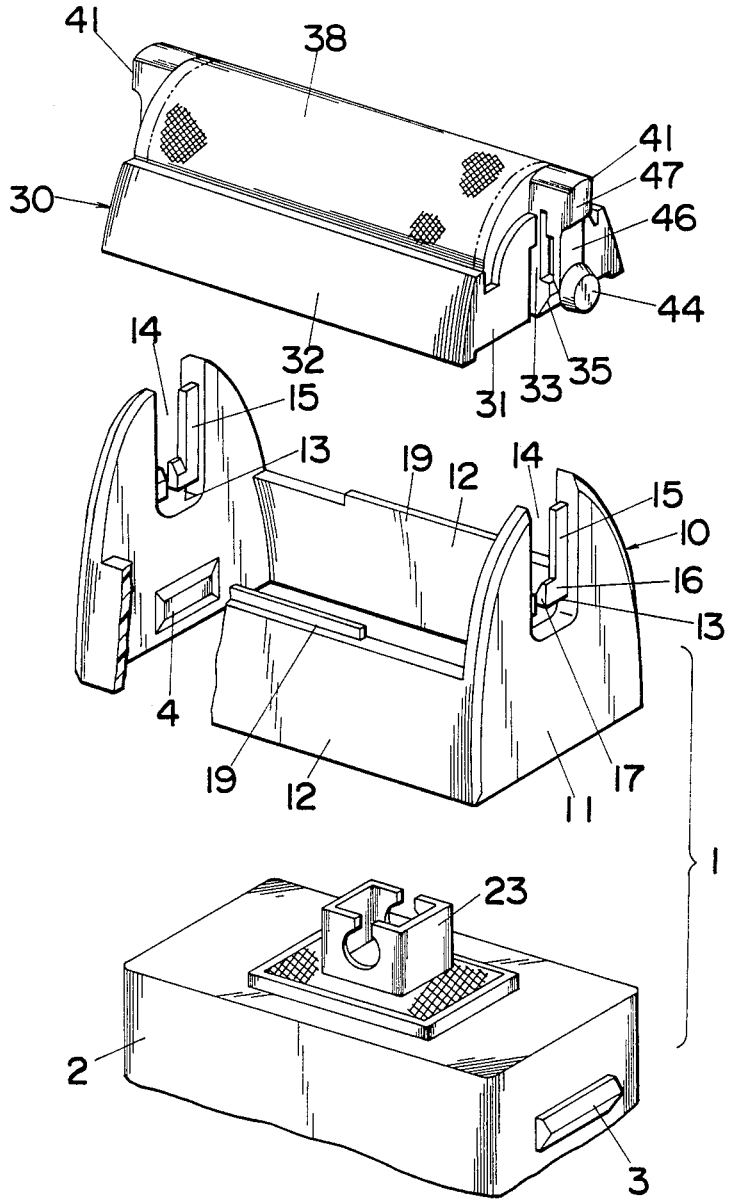
FIG. 2 is an exploded perspective view illustrating a top portion of a shaver housing, a support frame, and a head frame carrying a shearing foil constructing the shaver of FIG. 1.

Referring now to FIGS. 1 and 2, a shaver of this embodiment comprises a housing 1 mounting thereon an inner blade assembly 20 and a head frame 30 carrying a shearing foil 38. The inner blade assembly 20 is driven by an electric motor (not shown) in the housing 1 to reciprocate in shearing engagement with the undersurface of the shearing foil 38. The housing 1 is composed of a main housing 2 and a support frame 10 which is detachably mounted on the top of the main housing 2 by engaging a retractable latches 3 on either side of the main housing 2 into mating catch recesses 4 formed in the inner surface of the support frame 10. The inner blade assembly 20 comprises a plurality of arcuate cutter blades 21 supported on a base 22 which is detachably connected to a joint 23 projected on the top of the main housing 2 and driven to reciprocate. The support frame 10 is for detachably mounting the head frame 30 and is shaped from a rigid metallic or plastic material into a generally rectangular configuration having a pair of opposed end plates 11 the lower portion of which are integrally connected by opposed side plates 12. The head frame 30 is shaped from a plastic material into a generally rectangular configuration with a pair of opposed end walls 31 connected by opposed side walls 32. The shearing foil 38 is supported on the head frame 30 with its peripheral edges fixed such as by welding or any other bonding technique to the insides of the side walls 32 so as to be curved in conformity with the contour of the cutter blades 21. The head frame 30 thus carrying the shearing foil 38 is prepared as a unitary replacement part and for this purpose the head frame 30 itself is made preferably from an inexpensive plastic material to avoid adding extra cost to the replacement part.

Figure 3:
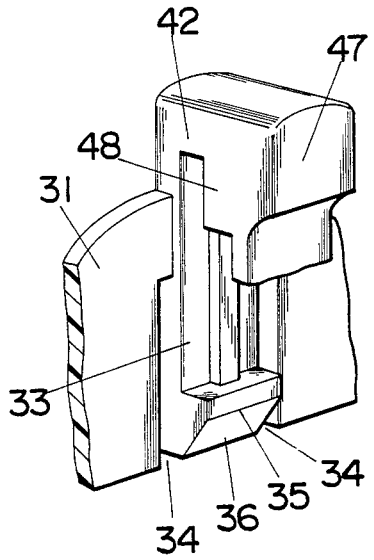
FIG. 3 is an enlarged perspective view illustrating the longitudinal end of the head frame of FIG. 2 with a release lever being cut away.
Figure 4:
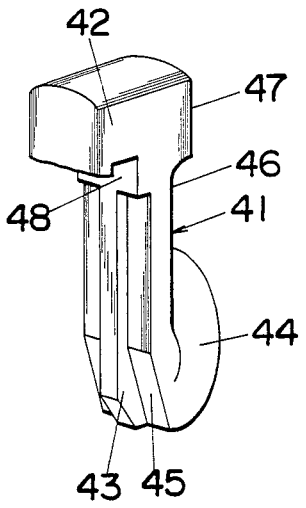
FIG. 4 is an enlarged perspective view showing the release lever of the head frame as viewed from a different angle from that of FIG. 3.
Figure 5:
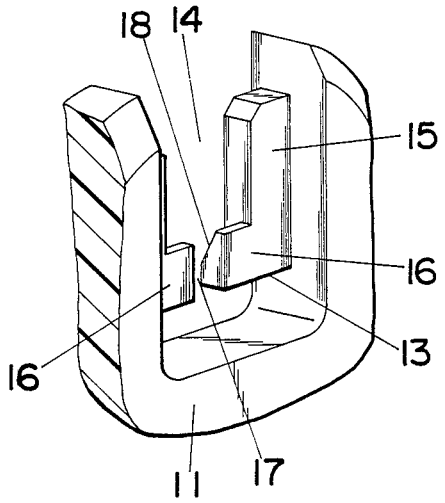
FIG. 5 is an enlarged perspective view showing an end wall of the housing formed with a slot.

In order to detachably mount the head frame 30 to the support frame 10 on the side of the housing 1, the head frame 30 has a pair of hooks 33 which come into locked engagement with complementary stops 13 formed respectively in the end plates of the support frame 10. Each of the hooks 33 is formed centrally of each end wall 31 of the head frame 30 and, as best shown in FIG. 3, has its lower major portion separated therefrom by vertical notches 34 to be allowed to resiliently flex inwardly. Formed on the lower end of each hook 33 is an enlarged latch end 35 which is tapered on its outwardly facing surface 36. As best shown in FIG. 5, each of the end plates 11 of the support frame 10 is formed with a top-opened slot 14 with a pair of vertically extending flanges 15 on its opposed side edges. The flanges 15 are integrally formed with the end plates 11 and extend adjacent the inner surface of the end plate 11 to define outwardly of itself a portion for receiving a release lever 41 which is formed on the head frame 30 and serves to disengage the hook 33, the detail of which will be discussed hereinafter. The lower ends of the flanges 15 terminate integrally in respective tabs 16 which are spaced upwardly of the bottom of the slot 14 to define at their lower edges the above stop 13 for a locked engagement with the latch end 35 of the hook 33. The tabs 16 extend toward one another to define between the ends thereof an open-slit passage 17 and are formed on the portions projecting beyond the adjacent flanges 15 with inwardly facing tapered surface 18.

Figure 6A:
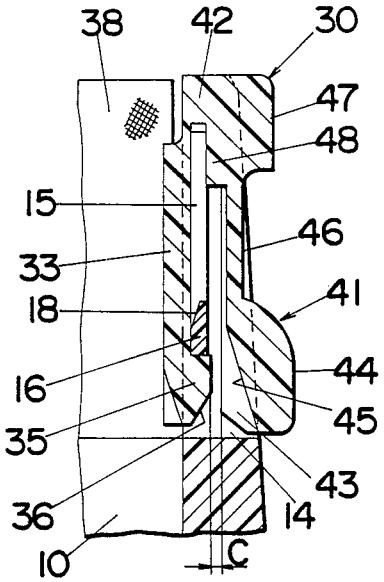
FIGS. 6A, 6B, 6C, and 6D are sectional views illustrating the sequence of removing the head frame from the housing.

When the head frame 30 is placed upon the support frame 10 with its end walls 31 inserted inside of the end plates 11, the hooks 33 have their latch ends 35 abutted at 36 against the tapered surface 18 of the tabs 16 to be thereby flexed inwardly enough to move the latch ends 35 past the tabs 16, after which they are resiliently urged outwardly into locked engagement with the stops 13, or the lower edges of the tabs 16, as shown in FIG. 6A, for retaining the head frame 30 in position. In this mounted position, the head frame 30 has its side walls 32 resting upon the side plates 12 of the support frame 10 with rails 19 on the upper edge of the side plates 12 engaged with the insides of the side walls 32.

Figure 6B:
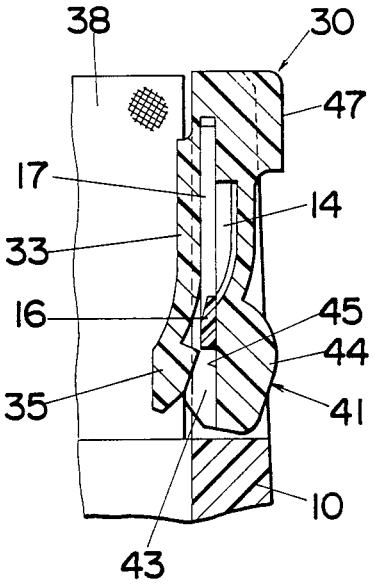
Figure 6C:
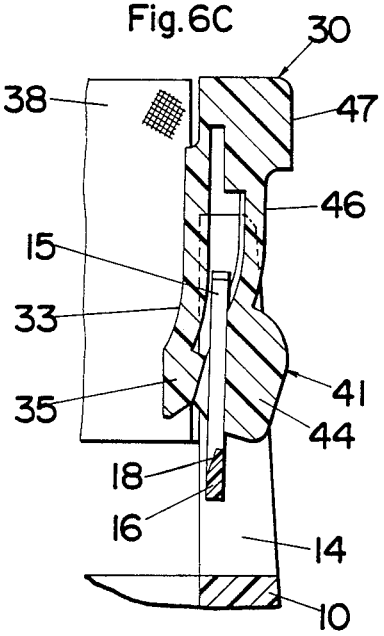
Figure 6D:
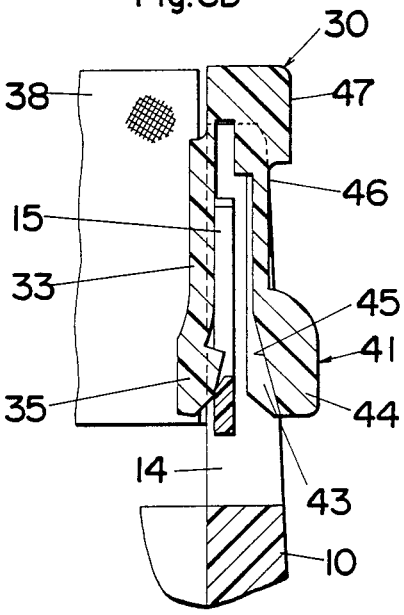

Also formed on the head frame 30 are a pair of the release levers 41 each extending integrally from the end wall 31 in outwardly adjacent relation to the corresponding hook 33. Each of the release levers 41 joins the upper end of the adjacent hook 33 through a segment 42 and depends therefrom in a substantially parallel relation to the hook 33 to be likewise capable of resiliently flexing inwardly. Each release lever 41 is formed at its lower end with an unlock stab 43 which projects inwardly toward the latch end 35 of the adjacent hook 33 and is also formed with an outwardly projection 44 forming a finger engaging button. When the head frame 30 is mounted on the support frame 10, the release levers 41 on the opposite ends thereof are received respectively in the slots 14 outwardly of the flanges 15 with the finger engaging buttons 44 as well as ears 47 at the upper outer ends of the release levers 41 projected on the outer surfaces of the corresponding end plates 11. In this condition, the unlock stab 43 of each release lever 41 is spaced outwardly from the latch end 35 to leave therebetween a clearance C. The portions on both sides of the unlock stab 43 are recessed to form thereat individual inclined guide surfaces 45. When it is required to remove the head frame 30 for a replacement or cleaning purpose, the release levers 41 are pressed in by the fingers of the user while holding the head frame 30 by the same fingers. Upon being pressed in, each release lever 41 is resiliently flexed inwardly to have the respective unlock stab 43 passed through the open-slit passages 17 into abutment with the latch end 35 of the hook 33. Further pressing in of the release lever 41 will cause the hook 33 to flex inwardly sufficiently for disengaging the latch end 35 from the stop 13, as shown in FIG. 6B. Once the release lever 41 is sufficiently flexed inwardly to disengage the hook 33 from the stop 13, the inclined guide surfaces 45 on both sides of the unlock stab 43 come into abutment against the lower end of the flanges 15, or the tabs 16, preventing the release lever 41 from flexing excessively inwardly. After the hooks 33 are disengaged, the user is only required to pull the head frame 30 upwardly to move the latch end 35 away from the tabs 16 while holding the head frame 30 by the same fingers to complete the removable of the head frame 30 from the support frame 30, as shown in FIGS. 6C and 6D. It should be noted at this time that the inclined guide surfaces 45 at the inner lower end of the release lever 41 are kept abutted against the flanges 15 in the slot 13 so long as the release lever 41 is flexed inwardly to disengage the latch end 35 from the stop 13 and move it upwardly away from the stop 13, limiting the amount of inward flexing movement of the release lever 41 all through this procedure.

Each release lever 41 is formed at a portion between the finger engaging button 44 and the ear 47 with a finger trapping recess 46 which serves to facilitate gripping. Also formed with each release lever 41 is bump 48 which projects inwardly from the upper end of the release lever 41 into constant abutment against the upper portions of the flanges 15 whereby the flanges 15 can bear any external shocks as applied to the release lever 41 to thereby keep the end wall 31 of the head frame 30 harmless from such external shocks which would otherwise distort the head frame 30 and result in the rupture of the shearing foil 38 of delicate construction.

Second Embodiment <FIGS. 7 to 10>

Figure 7:
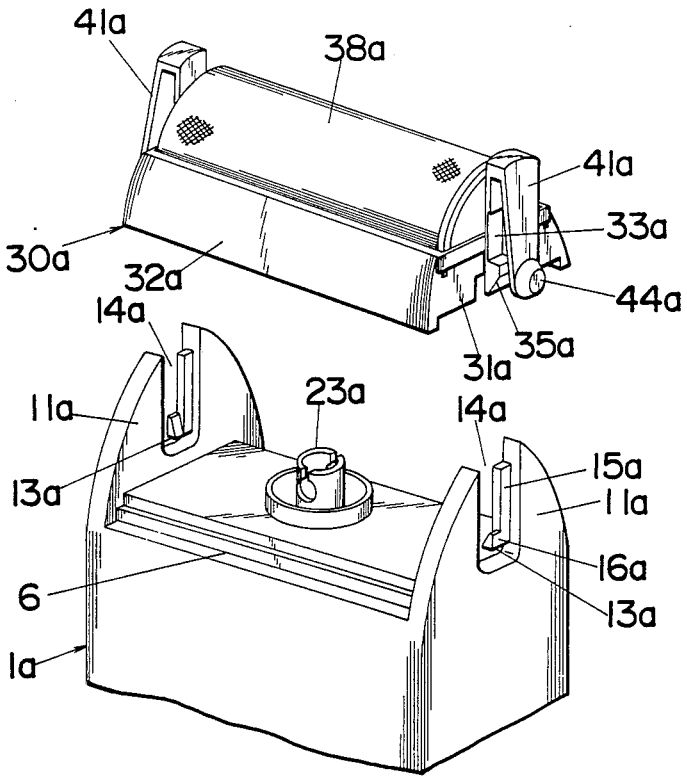
FIG. 7 is an exploded perspective view, partially cut away of a dry shaver in accordance with a second embodiment of the present invention.
Figure 8:
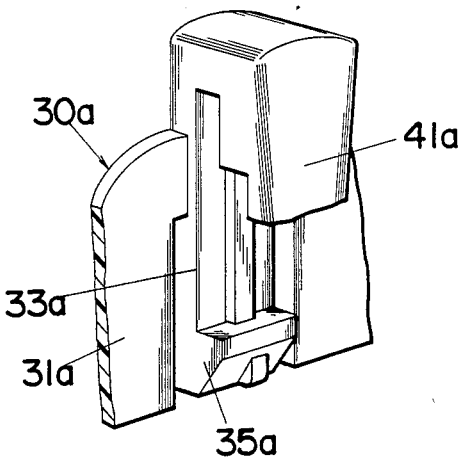
FIGS. 8 to 10 are partial views respectively similar to FIGS. 3 to 5 illustrating the longitudinal ends of the head frame and the housing of the shaver of FIG. 7.
Figure 9:
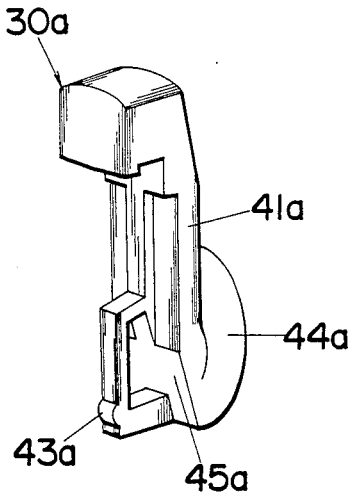
Figure 10:
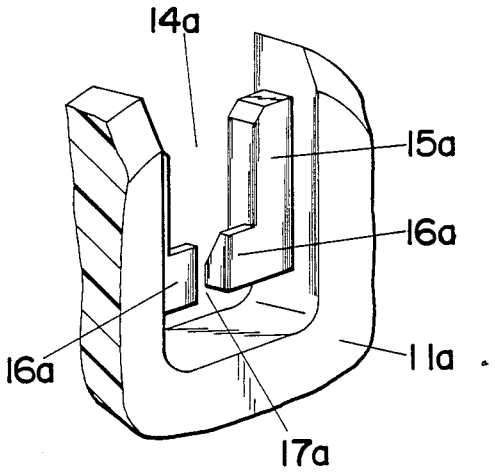

FIG. 7 shows a second embodiment of the dry shaver which is identical in construction to the above first embodiment except that a housing 1*a* is integrally formed with a pair of opposed end plates 11*a* in place of using the separate support frame. The same parts are designated by same numerals but suffixed with a letter "a". A head frame 30*a* is constructed to be identical in its functions with the exception that the ear at the upper end of each release lever 41*a* is eliminated so that only the finger engaging button 44*a* of each release lever 41*a* protrudes out of the slot 14*a* when the head frame 30*a* is mounted between the end plates 11*a*. In the mounted condition, the head frame 30*a* carrying a shearing foil 38*a* has its side walls 32*a* rested on stepped shoulders 6 extending edgewise between the opposed end plates 11*a* so that the side walls 32*a* can be flush with the front and rear faces of the housing 1*a*.

Figure 11:
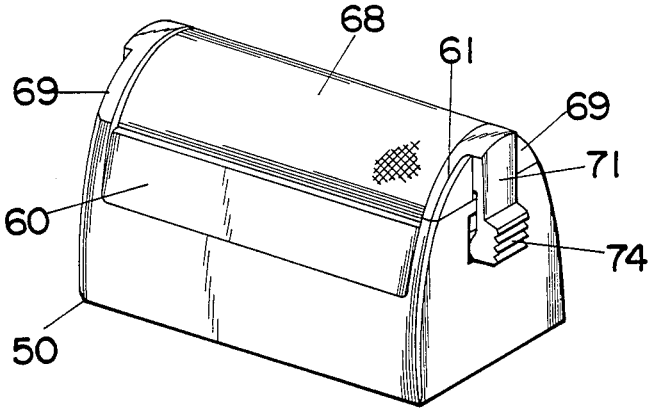
FIG. 11 is a perspective view of a top portion of a dry shaver in accordance with a third embodiment of the present invention.
Figure 12:
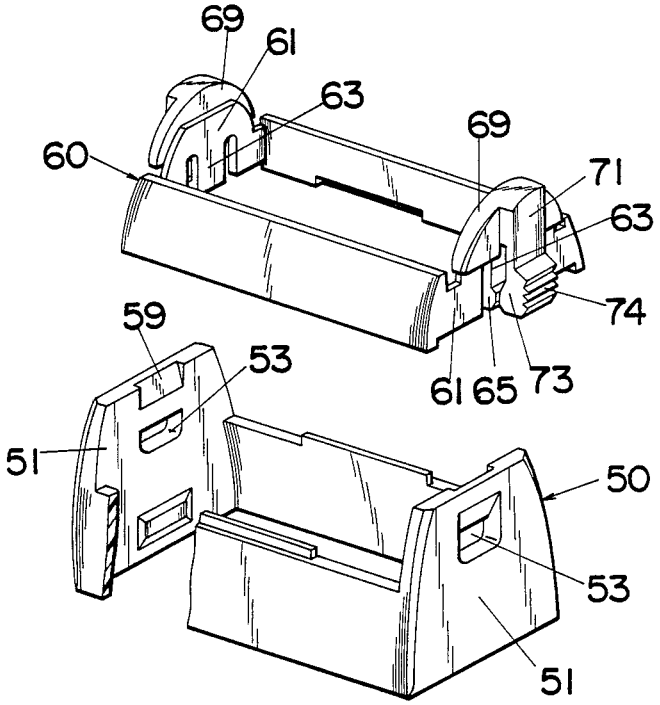
FIG. 12 is an exploded perspective view illustrating a head frame and a support frame forming the top portion of the shaver of FIG. 11.

Third Embodiment <FIGS. 11 and 12>

Figure 13:
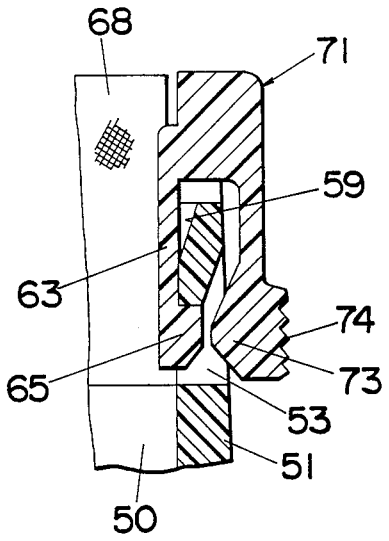
FIG. 13 is a sectional view illustrating the locking engagement between the head frame and the support frame of the shaver of FIG. 11.

Likewise in the first embodiment, a shaver head of this embodiment comprises a support frame 50 demountable to a main housing (not shown) and a head frame 60 carrying a shearing foil 68. The support frame 50 is identical in construction to that utilized in the first embodiment except that each of end plates 51 is formed with an aperture 53 instead of the slot 14. The aperture 53 defines a stop for locked engagement with a corresponding hook 63 formed in each end wall 61. As shown in FIG. 13, the portion of the end plate 51 above the aperture 53 has an inclined inner surface or cum surface 59 along which a latch end 65 at the lower end of the hook 63 is guided as flexing the hook 63 inwardly until it is engaged with the upper edge of the aperture 53. A release lever 71 depends integrally from the top of each end wall 61 in a substantially parallel relation to the adjacent hook 63 and has at its lower end an inwardly projecting unlock stab 73 abuttable against the latch end 65. The lower end of each resilient lever 71 is also formed with a finger engaging button 74 opposite to the unlock stab 73. When the release levers 71 are pressed in, the unlock stabs 73 will push the corresponding latch ends 65 inwardly for disengaging them from the apertures or stops 53, in the like manner as in the first embodiment, thus permitting the removal of the head frame 60. In this embodiment, each end wall 61 of the head frame 60 has its upper portion 69 projected to form thereat a crown 69 which is rested upon the upper edge of the corresponding end plate 51 of the support frame 50 when the head frame 60 is mounted with the lower portion of each end wall 61 disposed inside of the corresponding end plate 51 of the support frame 50.

Figure 14:
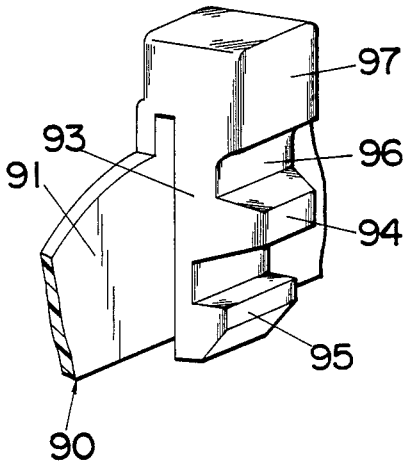
FIG. 14 is a perspective view of the longitudinal end of a head frame utilized in a dry shaver in accordance with a fourth embodiment of the present invention.
Figure 15:
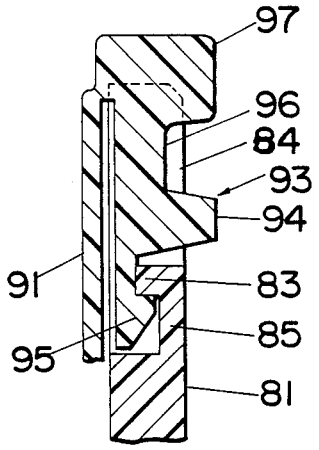
FIG. 15 is a sectional view illustrating the locking engagement between the head frame and a corresponding housing of the shaver of FIG. 14.

Fourth Embodiment <FIGS. 14 and 15>

A head frame 90 of this embodiment is similar to that of the first embodiment except for a structure responsible for a detachable engagement with end plates 81 on the part of a housing (not shown). The end plates 81 may be formed in the like support frame of the first embodiment or may be formed as integral members in the main housing of the second embodiment. The head frame 90 carrying the like shearing foil (not shown) has a pair of opposed end walls 91 (only one of which is seen) each having a single resilient member 93 which depends from the top of the end wall 91 in outwardly spaced relation thereto so that it is capable of resiliently flexing inwardly toward the end wall 91. The resilient member 93 is formed at its lower end with an outwardly projecting latch end 95 for a locked engagement with a corresponding stop 83 formed in the corresponding end plate 81 on the part of the housing. Upwardly of the latch end 95 the resilient member 93 is also formed with a finger engaging button 94 which projects outwardly and is cooperative with a ear 97 at the top of the resilient member 93 to form therebetween a finger trapping recess 96. Each of the end plates 81, inside of which the end wall 91 of the head frame 90 is mounted, is formed with a top-opened slot 84 with a post 85. The post 85 projects integrally from the bottom of the slot 84 and has its upper end bent inwardly to form the stop 83 for locked engagement with the latch end 95. In the mounted condition of FIG. 15, each resilient member 93 has its major portion received in the slot 84 with its finger engaging button 94 projecting outwardly of the slot 84 to be accessible by the finger of the user. When the buttons 94 are pressed in, the resilient members 93 are flexed inwardly to disengage the latch ends 95 from the stop 83, permitting the removal of the head frame 90. In this sense, the resilient member 93 has a dual function of attaching and releasing the head frame 90 to and from the housing.

Fifth Embodiment <FIGS. 16 to 19>

Figure 16:
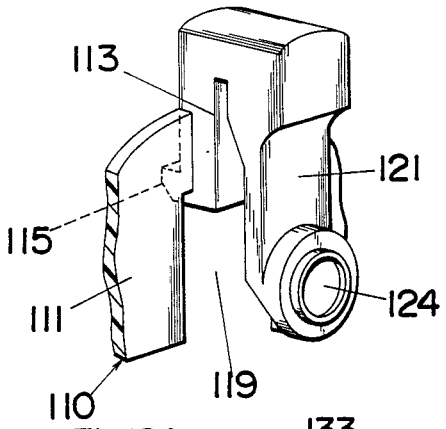
FIG. 16 is a perspective view of the longitudinal end of a head frame utilized in a dry shaver in accordance with a fifth embodiment of the present invention.
Figure 18B:
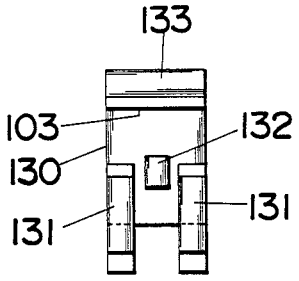
FIGS. 18A and 18B are respectively perspective view and front view of a resilient element fixed to the housing of FIG. 17.
Figure 18A:
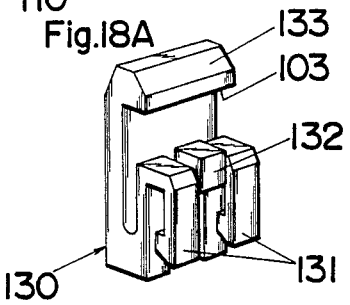
Figure 19:
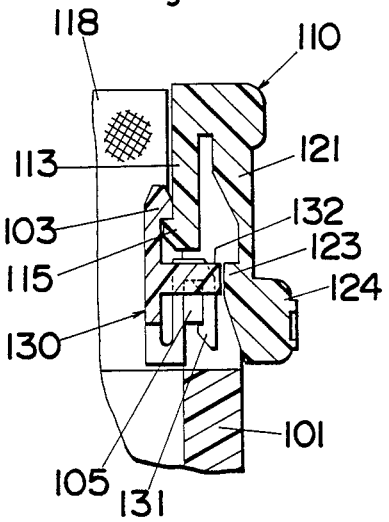
FIG. 19 is a sectional view illustrating the locking engagement between the head frame of FIG. 16 and the housing of FIG. 17.
Figure 17:
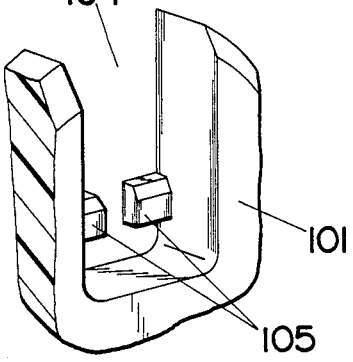
FIG. 17 is a perspective view illustrating a top portion of a housing receiving the head frame of FIG. 16.
Figure 20:
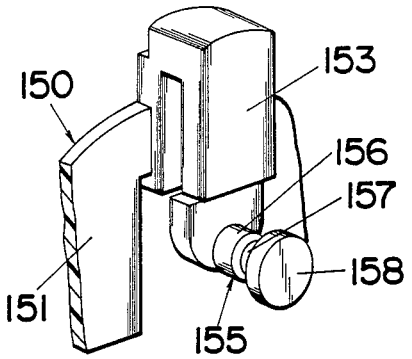
FIG. 20 is a perspective view of the longitudinal end of a head frame utilized in a dry shaver in accordance with a sixth embodiment of the present invention.
Figure 21:
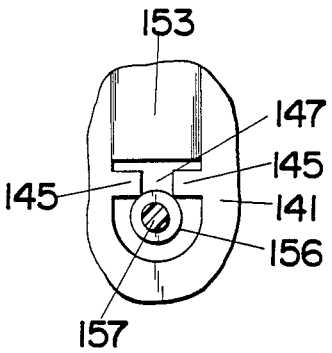
FIG. 21 is a partial side view of the head frame of FIG. 20 in the locked condition with a housing.
Figure 22:
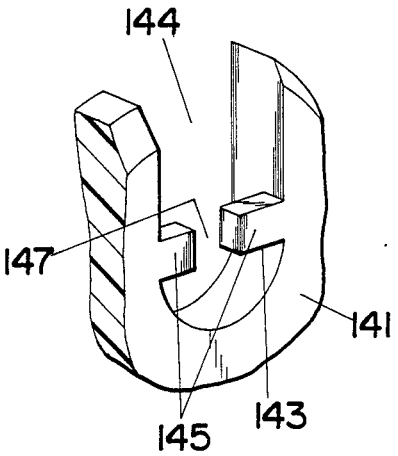
FIG. 22 is a perspective view of the longitudinal end of the housing receiving the head frame of FIG. 20.

A head frame 110 of this embodiment is similar to that of the first embodiment except for a structure responsible for a detachable engagement with end plates 101 on the part of a housing (not shown). The end plates 101 may be formed in the like support frame of the first embodiment or may be formed as integral members in the main housing of the second embodiment. The head frame 110 carrying the like shearing foil 118 has a pair of opposed end walls 111 (only one of which is seen) each having an integral hook leg 113 for a locked engagement with a stop 103 formed in the corresponding end plate 101 and further having an integral release lever 121 with a finger engaging button 124. As shown in FIG. 16, the hook leg 113 is formed above a notch 119 in the center of the end wall 111 and has at its lower end a latch end 115 projecting inwardly of the end wall 111. The stop 103 for receiving the latch end 115 is formed on a separately formed resilient element 130 fixed to the end plate 101 on the part of the housing. The resilient element 130 has a pair of U-shaped anchors 131 which are fixedly engaged with respective props 105 projecting in the lower portion of a top-opened slot 104 formed in each end plates 101 so that the upper portion of the resilient element 130 can flex inwardly for detachable engaging the stop 103 to the latch end 115 of the hook leg 113. A stud 132 is formed on the resilient element 130 to project between the upper portions of the anchors 131. The lease lever 121 depends integrally from a raised top end of the hook leg 113 to be capable of resiliently flexing inwardly toward the resilient element 130 in the slot 104 and is formed at its inner lower end with an unlock stab 123 abuttable with the stud 132 on the resilient element 130. When the release lever 121 is pressed in, the unlock stab 123 will press the stud 132 to correspondingly flex the resilient element 130 inwardly, disengaging the stop 103 from the latch end 115 of the hook leg 113, thus enabling the removable of the head frame 110. The stop 103 at the top of the resilient element 130 has a tapered cum surface 133 for guiding the latch end 115 therepast to effect the locking engagement with the stop 103 when the head frame 110 is placed in between the end plates 101.

Sixth Embodiment <FIGS. 20 to 23>

Figure 23:
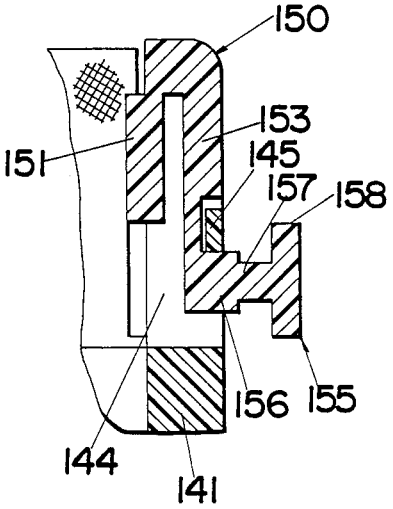
FIG. 23 is a sectional view illustrating the locking engagement between the head frame of FIG. 20 and the housing of FIG. 22.

A head frame 150 of this embodiment is similar to that of the forth embodiment in the sense that a single resilient member 153 is provided on each end wall 151 of the head frame 150 to effect a dual function of being hooked and unhooked to and from a corresponding beam 145 formed on the part of the housing. The resilient member 153 is connected integrally with a raised top of each end wall 151 and depends therefrom in a parallel relation to the plane of the end wall 151 so as to be capable of flexing inwardly. At the outer lower end of the resilient member 153 there is formed a sepped pin 155 with sections 156, 157, and 158 of different diameters. The first section 156 adjacent the lower end of the resilient member 153 has a diameter larger than the second section 157 aligned on the same axis but spaced away therefrom. The third section 158 at the outermost end of the stepped pin 155 has a maximum diameter and forms a finger engaging button to be accessible by the finger of the user. The head frame 150 is mounted between end plates 141 at the top of a housing (not shown). Such end plates 141 may be included in the like support frame as utilized in the first embodiment or may be included as integral members of a shaver housing. Each end plate 141 is formed with a top-opened slot 144 with a pair of beams 145 which project horizontally from the side edges of the slot 144 toward each other to define therebetween an open-slit passage 147. The passage 147 has a width which only allows the second section 157 of the pin 155 to pass therethrough and inhibits the passage of the other sections of the pin 155. Thus, the beams 145 act as the stop for the first section 156 to retain the head frame 150 between the end plates 141, as shown in FIG. 23. To detach the head frame 150, each resilient member 153 is pressed to flex inwardly to register the second section 157 to the passage 147, after which the head frame 150 is removed simply by being pulled upwardly to pass the second section 157 through the passage 147.

Figure 24:
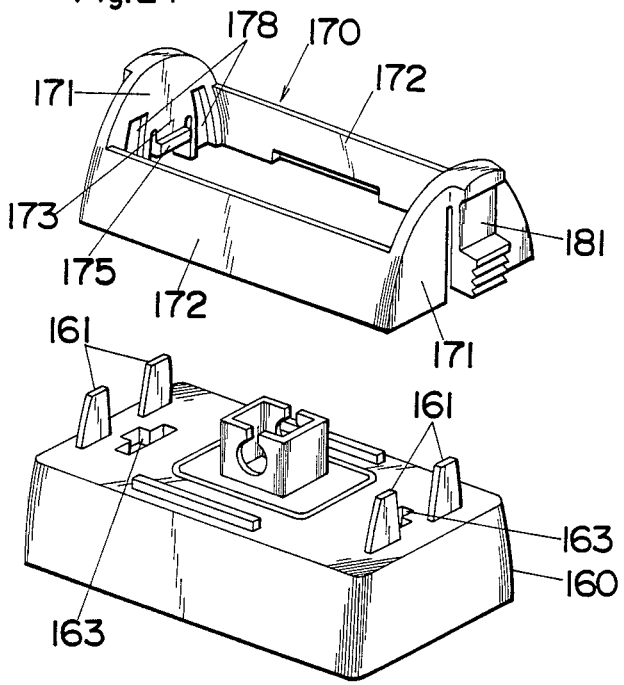
FIG. 24 is an exploded perspective view of a dry shaver in accordance with a seventh embodiment of the present invention.
Figure 25:
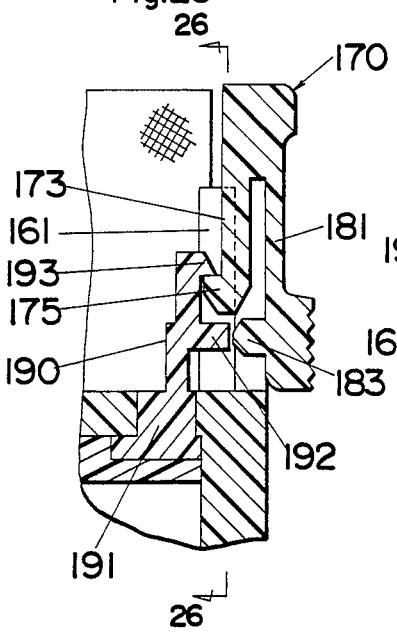
FIG. 25 is a sectional view illustrating a locking engagement between a head frame and a housing of the shaver of FIG. 24.
Figure 26:
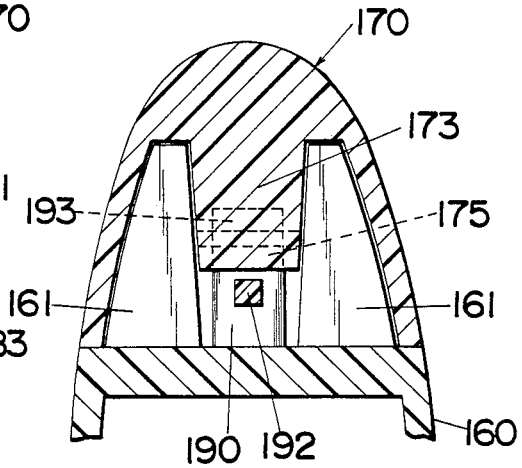
FIG. 26 is a sectional view taken along line 26—26 of FIG. 25.

Seventh Embodiment <FIGS. 24 to 26>

A head frame 170 of this embodiment is similar in construction to the previous embodiments but is somewhat different therefrom in that it has its end walls 171 as well as side walls 172 entirely exposed when mounted on the top of a housing 160. For this purpose, a pair of end plates 161 projected on the opposite ends of the housing 160 are received in corresponding recesses 178 formed in the inner surfaces of each end wall 171. Each end wall 171 of the head frame 170 is integrally formed with a hook 173 and a release lever 181 both depending from the top of the end wall 171 in parallel relation to each other. The hook 173 is relatively thick and extends a short length to be a rigid member while the release lever 181 is relative thin and extends a longer length to be capable of resiliently flexing inwardly toward the hook 173. The hooks 173 has at its lower end an inwardly projecting latch end 175 for locked engagement with a stop shoulder 193 formed at the upper end of a resilient element 190 projecting on the top of the housing 160. The resilient element 190 is fixed to the housing 160 with its lower anchor end 191 secured into a hole 163 formed inwardly of the end plates 161 so that the upper portion of the resilient element 190 is capable of flexing inwardly. Formed on the middle of the resilient element 190 is a stud 192 projecting outwardly between the end plates 161 to be abuttable with an unlock stab 183 projecting inwardly from the lower end of the release lever 181. When the head frame 170 is placed on the housing 160, the latch end 175 of each hook 173 will push the stop shoulder 193 inwardly after which it comes into locked engagement with the stop shoulder 193. To remove the head frame 170 from the housing 160, each of the release levers 181 is flexed inwardly to let the unlock stub 183 press the resilient element 190 inwardly, whereby disengaging the stop shoulder 193 from the latch end 175 of the adjacent hook 173.

What is claimed is:

1. A dry shaver comprising:

a housing mounting on its top a generally elongated inner blade assembly driven to reciprocate along the longitudinal axis of said inner blade assembly; and a head frame demountable mounted on said housing and carrying a shearing foil, said head frame being of rectangular configuration including a pair of opposed end walls connected by opposed side walls and detachably mounted on the top of said housing so that the inner blade assembly projects into the head frame for shearing engagement with the undersurface of said shearing foil, each of said end walls having a hook engageable with a corresponding stop formed as a stationary element on the side of said housing for retaining said head frame on the top of said housing;

each of said end walls further including a release lever extending integrally from the end wall adjacent to said hook and being allowed to flex resiliently for disengaging said hook from the corresponding stop, said hook extending inwardly of said release lever and said hook being flexible resiliently inwardly, the arrangement being such as to permit said head frame to be removed from the housing by inward flexing of the release lever to cause the hook to flex inwardly for disengagement of the hook from the stop and each of said release levers having a finger engaging portion exposed to be accessible by a finger of a user.

2. A dry shaver as set forth in claim 1, wherein said finger engaging portion forms a button which projects outwardly of the top portion of the housing.

3. A dry shaver comprising:

a housing mounting on its top an elongated inner blade assembly, said housing formed on its top with opposed end plates between which said inner blade assembly is driven to reciprocate along the longitudinal axis of said inner blade assembly; and a head frame demountable mounted on said housing and carrying a shearing foil, said head frame being of rectangular configuration including a pair of opposed end walls connected by opposed side walls and detachably mounted on the top of said housing between the end plates thereof so that the inner blade assembly projects into the head frame for shearing engagement with the undersurface of said shearing foil, each of said end walls having a hook engageable with a corresponding stop formed as a stationary element on the side of said housing for retaining said head frame on the top of said housing;

each of said end walls further including a release lever extending integrally from the end wall adjacent to said hook to be allowed to resiliently flex inwardly for disengaging said hook from the said stop, said hook extending inwardly of said release lever and said hook being flexible resiliently inwardly, the arrangement being such as to permit the head frame to be removed from the housing by inward flexing of the release lever to cause the hook to flex inwardly for disengagement of the hook from the stop and each of said release levers having a finger engaging portion exposed to be accessible by a finger of a user.

4. A dry shaver as set forth in claim 3, wherein said finger engaging portion forms a button which projects outwardly of the top portion of the housing.

5. A dry shaver as set forth in claim 3, wherein each of said end plates of the housing is formed with an aperture, said hook extending integrally from the end wall of said head frame and connected at its top end thereto so as to be allowed to resiliently flex inwardly, said hook having at its lower end a latch end for a locking engagement with said aperture, said end plate having on its inner surface upwardly of said aperture an inclined surface along which the latch end of the hook is guided as flexing said hook into the locked engagement with the aperture, said release lever extending integrally from said end wall in spaced relation to said hook outwardly thereof and allowed to resiliently flex inwardly toward said hook, said release lever having at its lower free end an inwardly projecting unlock stab which enters said aperture and presses the latch end of said hook inwardly for disengaging it from the stop when the release lever is flexed inwardly.

6. A dry shaver as set forth in claim 3, wherein said end plates are formed integrally with the housing to project upwardly therefrom.

7. A dry shaver comprising a housing mounting on its top an elongated inner blade assembly, said housing formed on its top with opposed end plates between which said inner blade assembly is driven to reciprocate along the longitudinal axis of said inner blade assembly; and a head frame demountable mounted on said housing and carrying a shearing foil, said head frame being of rectangular configuration including a pair of opposed end walls connected by opposed side walls and detachably mounted on the top of said housing between the end plates thereof so that the inner blade assembly projects into the head frame for shearing engagement with the undersurface of said shearing foil, each of said end walls having a hook engageable with a corresponding stop formed as a stationary element on the part of said housing for retaining said head frame on the top of said housing;

each of said end walls further including a release lever extending integrally from the end wall adjacent to said hook to be allowed to resiliently flex inwardly for disengaging said hook from the said stop, so as to permit the head frame to be removed from the housing, and each of said release levers having a finger engaging portion exposed to be accessible by a finger of a user and wherein each of said end plate is formed with a top-opened generally vertical slot having a pair of tabs projecting from its side edges to define outwardly of said tabs a portion for receiving said release lever, said tabs spaced upwardly from the bottom of said slot to define at its lower edges said stop and projecting to one another to define therebetween an open-slit passage, each of said hooks extending integrally from each of said end walls of the head frame and having at its lower end a latch end for a locking engagement with said stop, said hook being connected at its top end to the end wall so as to be resiliently flexible inwardly, each of said release levers extending along said hook outwardly thereof and having at its lower end an inwardly projecting unlock stab abuttable against said latch end, said release lever being connected its top end to the end wall so as to be resiliently flexible inwardly toward said hook, whereby the inward flexing of the release lever causes the unlock stab to move through said passage to push the latch end inwardly for disengaging it from said stop while the lower end of the release lever adjacent the unlock stab comes into abutment with said tabs so as to limit the inward displacement of the release lever, preventing it from urging the hook excessively inwardly.

8. A dry shaver as set forth in claim 7, wherein said unlock stab of the release lever is spaced from the latch end of the hook to define therebetween a clearance.

9. A dry shaver as set forth in claim 7, wherein each of said release levers having at its lower end an outward projecting button which defines said finger engaging portion, said release lever being formed in its outer surface upwardly of said button with a finger trapping recess.

10. A dry shaver as set forth in claim 7, wherein each of said vertical slot having along its inner side edges flanges each terminating at its lower end in each of said tabs, said release lever being formed at its upper end with an inwardly projecting bump for constant abutment against said flanges when said head frame is mounted to said housing.

11. A dry shaver as set forth in claim 8, wherein said release lever is formed adjacent said unlock stab with an inclined guide surface which comes in sliding surface contact with the flanges and the tabs when the release lever is flexed inwardly to disengage the latch end from the stop, permitting the head frame to be removed upwardly from the housing in such a manner as to slide said inclined guide surface along said flanges.

12. A dry shaver comprising a housing mounting on its top an elongated inner blade assembly, said housing formed on its top with opposed end plates between which said inner blade assembly is driven to reciprocate along the longitudinal axis of said inner blade assembly; and a head frame demountable to said housing and carrying a shearing foil, said head frame being of rectangular configuration including a pair of opposed end walls connected by opposed side walls and detachably mounted on the top of said housing between the end plates thereof so that the inner blade assembly projects into the head frame for shearing engagement with the undersurface of said shearing foil, each of said end walls having a hook engageable with a corresponding stop formed as a stationary element on the part of said housing for retaining said head frame on the top of said housing;

each of said end walls further including a release lever extending integrally from the end wall adjacent to said hook to be allowed to resiliently flex inwardly for disengaging said hook from the said stop, so as to permit the head frame to be removed from the housing, and each of said release levers having a finger engaging portion exposed to be accessible by a finger of a user and wherein said housing comprises a main housing mounting therein means for driving said inner cutter assembly and a support frame detachable to the top of the main housing, said support frame being a rectangular frame including said ends plates integrally connected by opposed side plates and detachably supporting said head frame between said end plates by said engagement between the hook and the stop.

* * * * *